United States Patent [19]

Gil

[11] Patent Number: 4,952,183

[45] Date of Patent: Aug. 28, 1990

[54] COLLAPSIBLE PROPULSION AIDS FOR SWIMMER'S FEET

[76] Inventor: Yoram Gil, 1411 S. Beverly Glen Rd., Los Angeles, Calif. 90024

[21] Appl. No.: 380,389

[22] Filed: Jul. 17, 1989

[51] Int. Cl.[5] ..... A63B 31/00

[52] U.S. Cl. ..... 441/64; 441/55; 441/61

[58] Field of Search ..... 441/55, 61, 63, 64, 441/75; 36/8.1, 11.5, 113, 116

[56] References Cited

U.S. PATENT DOCUMENTS

| | | | |
|---|---|---|---|
| 1,607,857 | 11/1926 | Zukal | 441/64 |
| 2,672,629 | 3/1954 | Trell | 441/64 |
| 2,903,719 | 9/1959 | Wozencraft | 441/64 |
| 2,980,926 | 4/1961 | Wolshinl | 441/64 |
| 3,178,738 | 4/1965 | La Trell | 441/64 |
| 3,952,351 | 4/1976 | Gisbert | 441/64 |
| 4,250,584 | 2/1981 | Korn | 441/61 |
| 4,599,071 | 7/1986 | Juang | 441/64 |

*Primary Examiner*—Joseph F. Peters, Jr.
*Assistant Examiner*—Clifford T. Bartz
*Attorney, Agent, or Firm*—Philip D. Junkins

[57] ABSTRACT

A flipper-type swimming propulsion aid assembly for attachment to the feet of a swimmer to increase the swimmer's effective foot area. The swimming aid for each foot includes a collapsible frame of generally isosceles triangular configuration having side frame members of substantially equal length which are pivotally joined through a heel plate at the heel end of the frame and a foldable cross frame member joining the free or toe ends of the side frame members. The swimming aid also includes a fabric or plastic sheet web component which is placed over the collapsed frame assembly and thereater the side frame members are separated with the cross frame member opened and extended. The web component is provided with a flap portion at its toe end and such portion is positioned to surround and maintain the cross frame member in its extended orientation and thereby stretch the triangular web component over the assembled frame so that when the swimming propulsion aids are affixed to the swimmer's feet the effective propulsion area of the sole are of each foot is increased by at least double that of the sole per se. Foot and ankle straps are provided for affixing the swimming aid assemblies to the swimmer's feet.

7 Claims, 1 Drawing Sheet

COLLAPSIBLE PROPULSION AIDS FOR SWIMMER'S FEET

FIELD OF THE INVENTION

This invention relates to means to be used by a swimmer as an aid to propelling the swimmer through the water. More particularly, the invention relates to light-weight collapsible fin means to be worn on the feet of an untrained or experienced swimmer to assist in propelling such swimmer through the water more rapidly over greater distances with reduced effort.

BACKGROUND OF THE INVENTION

For many years there has been a developing interest in swimming appliances and propulsion aids for swimmers. particular attention has been given by swimmers to the design and development of foot wear for use in swimming. One approach to increasing the forward push or thrusting action obtainable from a swimmer's legs and feet has been the provision of swimming shoes. Swimming shoes of one general type have lateral wings that swing outwardly into the plane of the shoe's sole during alternating push or thrust type strokes of the swimmer's legs and that swing toward each other and reside rearwardly of the boarders of the shoe sole during a forward or retracting portion of the swimmer's leg stroke so that little or no resisting surfaces of the wings are presented to the water during this movement of the swimmer's leg strokes. Examples of this form of swimmer's foot gear are disclosed in U.S. Pat. No. 1,043,770 granted to G.M. Larson, U.S. Pat. No. 1,506,885 granted to A. Cech and U.S. Pat. No. 1,626,541 granted to J.P. LaRosa.

Another approach to the provision of swimming shoe designs has been proposed in U.S. Pat. No. 1,626,175 granted to Zimmer and U.S. Pat. No. 1,983,609 granted to W.T. Hudson. In these patents lateral thrust wings are affixed in hinged manner to the shoe sole along the central longitudinal axis of the sole or to a central plate or platform along the central longitudinal axis thereof with the swimmer's foot strapped to such plate or platform. Again, these swimming aids are utilized where the swimmer utilizes a push or thrust type stroke of the legs followed by forward or retracting movement of the legs and such swimming aids are heavy, cumbersome and unwieldy and frequently come into interfering contact with one-another during the pushing portion of the leg strokes.

A further design for foot gear for use in swimming has been proposed by P.J. Griffin in his U.S. Pat. No. 719,583 wherein lateral water thrust wings are hinged to a beam which is attached to and projects from an anklet ring worn on the swimmer's leg above each ankle. The beam on each of the swimmer's legs extends forwardly from the shin area above the ankle with the lateral wings moving outwardly above the forward portion and toes of each foot during leg thrust motion and inwardly and downwardly to the foot during the retracting portion of each leg stroke. The Griffin swimming gear requires that a strut extend from a metallic portion of a foot socket to the beam supporting the thrust wings to maintain such beam in its forwardly extending orientation from the swimmer's leg. As in the case of the previously described patented swimming aids, the Griffin gear is heavy, cumbersome and unweldy with the inside thrust wings of each foot-borne structure often interfering with each other.

Still further designs for swimmer's foot gear have been disclosed in U.S. Pat. No. 1,607,857 granted to F. Zukal and U.S. Pat. No. 2,672,629 granted to J.K. Latrell and comprise foot "flipper-type" swimmer's propulsion aids where the effective areas of the soles of the swimmer's feet are increased. With such gear, increased swimming propulsion force is derived during relatively normal flutter kicking action of the swimmer's legs and feet in an extended orientation without a reciprocating action of the legs. Collapsible forms of swim fin types of swimming propulsion aids are also disclosed in U.S. Pat. No. 4,250,584 granted to G. Korn and French Pat. No. 2,675,927 granted to T. Rolland.

It is an object of the present invention to provide swimming propulsion aids for attachment to each foot of a swimmer with the aids being of light-weight construction and collapsible for convenient and compact storage.

It is another object of the invention to provide a pair of light-weight swimming propulsion aids for rapid attachment to the feet of a swimmer to assist in propelling the swimmer through the water with a minimum of leg flutter-kick action.

It is still a further object of the invention to provide light-weight collapsible swimming propulsion aids that may be rapidly assembled and attached to the feet of a swimmer to enable and enhance the propelling of the swimmer through the water more rapidly over greater distances with normal flutter-kick action of the swimmer's legs and feet.

It is yet another object of the invention to provide a pair of light-weight swimming propulsion aids for rapid assembly and attachment to the feet of a swimmer with such aids being oriented so as to not interfere with one another during normal flutter kick action of the swimmer's legs.

Other objects and advantages of the invention will become apparent from the following summary and detailed description of a preferred embodiment of the invention taken in conjunction with the accompanying drawing figures.

SUMMARY OF THE INVENTION

The present invention relates to a pair of swimming propulsion aids of "flipper-type" for attachment to the feet of a swimmer with the aids or devices being of light-weight construction and capable of rapid assembly from pre-use compact stored or packaged components. The assembled swimming aid for each foot is affixed to the sole of the foot by foot and ankle straps and substantially increases the foot area for assisting the forward propulsion of the swimmer through the water. The propulsion aids of the invention are particularly useful for a swimmer performing the well-known "American crawl" stroke which combines a hand-over-head arm stroke with a flutter kick of the legs and with the feet lashing upward and backward. The propulsion aids are also useful in performing the backstroke, much like the crawl turned upside down, with the swimmer using a flutter kick.

In accordance with the invention the swimming aid structure or assembly for each foot is comprised of a strong fabric or flexible sheet plastic web component of generally triangular configuration applied to and supported on and by a collapsible frame. The frame is comprised of side frame members hinged together at their heel ends, extending in divergent manner from the heel of each foot forwardly along the sole and for a distance beyond the toes, and a cross frame member extending between the toe ends of the side frame members for maintaining the side members in their desired divergent orientation at the toe end of the assembly. The cross frame member is hinged in its middle portion so that the side frame members may be collapsed together. The fabric or plastic web component of the assembly is placed over the collapsed frame assembly and thereafter the side frame members are separated with the cross frame member opened and extended. The web component is provided with a flap portion at its toe end and such portion is positioned to surround and maintain the cross frame member in its extended orientation and thereby stretch the triangular web component over the assembled frame so that when the swimming propulsion aids are fixed to the swimmer's feet the effective propulsion area of the sole area of each foot is increased by at least double that of the sole per se. The foot and ankle straps for affixing the swimming aid assemblies to the swimmer's feet are preferably comprised of strong non-stretchable fabric material with VELCRO brand interlocking type hook and eye fastener means.

BRIEF DESCRIPTION OF THE DRAWING FIGURES

DETAILED DESCRIPTION OF THE PREFERRED EMBODIMENTS

Figure 1:
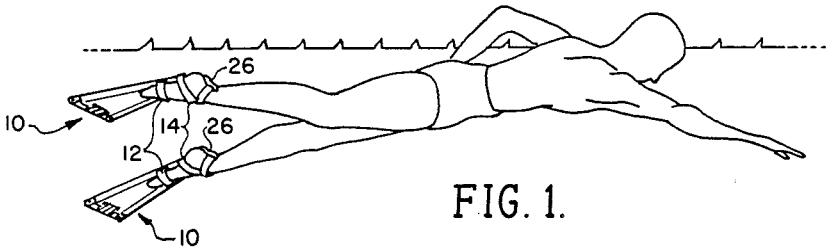
FIG. 1 is a side view showing a pair of the swimming propulsion aids of the invention in use upon the feet of a swimmer.

Referring initially to FIG. 1 there is illustrated in a partial showing a swimmer utilizing a pair of the swimming propulsion aids 10 of the invention mounted to the feet of the swimmer. As shown, the swimmer legs are extended rearwardly in position to effect a flutter kick of each leg for use in performing the "American crawl" stroke with the feet and attached propulsion aids lashing upward and backward. Each of the swimming propulsion aids 10 is maintained of the swimmer's foot by a foot strap 12 and an ankle strap 14.

Figure 2:
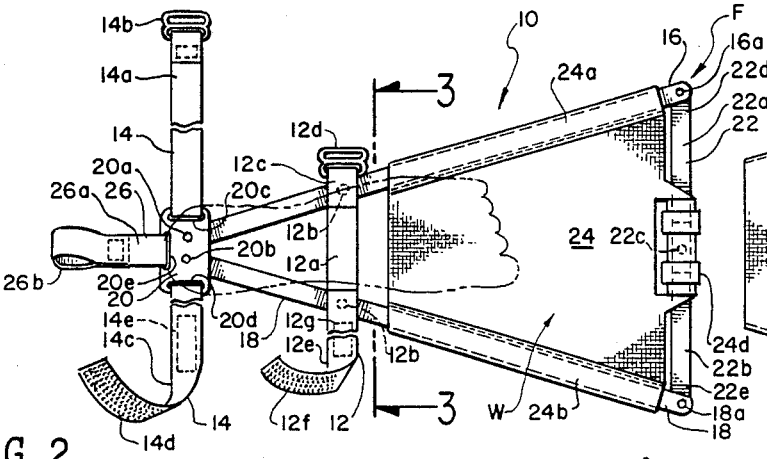
FIG. 2 is a top plan view of one of the swimming propulsion aids of the invention in its assembled orientation With a swimmer's left foot shown in phantom in its position for attachment of the swimming aid by the associated foot and ankle straps thereof.

In FIG. 2 there is shown, in a top plan view, a swimming propulsion aid 10 of the invention with a swimmer's left foot shown in phantom in its position for attachment of the propulsion aid to the foot by a foot strap 12 and an ankle strap 14. The propulsion aid 10 is comprised of a collapsible triangular frame F and a web W of strong fabric (or flexible sheet plastic) material supported on and by the frame. The collapsible triangular frame is comprised of: side frame members 16 and 18 (of like configuration and of equal length) which are pivotally joined to one-another at the heel end of the frame by a heel plate 20; and a cross frame member 22 which includes two components **22*a* and 22*b* which are foldably connected at a central pivot point 22*c*. The foldable cross frame member is attached at its end portions 22*d* and 22*e* to the toe ends of side frame members 16 and 18 at pivot points 16*a* and 18*a*, respectively. The heel ends of side frame members 16 and 18 are pivotally affixed to heel plate 20 at pivot points 20*a* and 20b**, respectively, of such plate.

Figure 3:
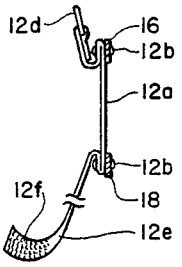
FIG. 3 is a cross-sectional view of the swimming propulsion aid of FIG. 2 taken on line 3—3 of FIG. 2 showing particularly the arrangement of the foot strap of the assembly with respect to the side frame members thereof.
Figure 4:
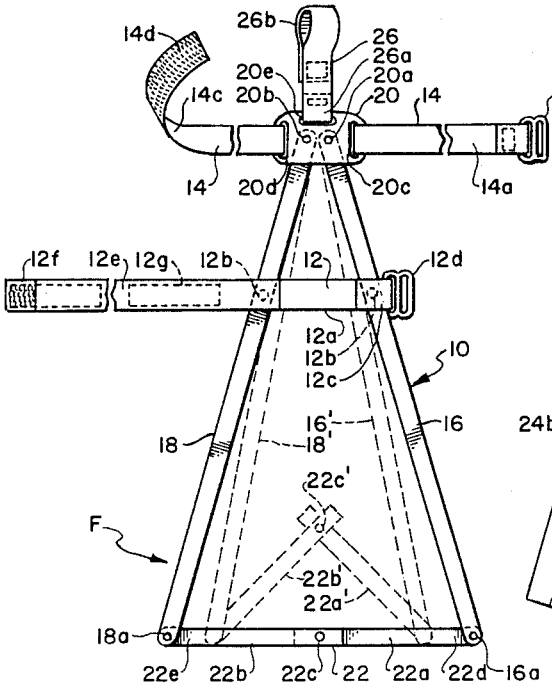
FIG. 4 is a top plan view of one of the frame assemblies of the swimming propulsion aid of the invention with its associated foot and ankle straps, without the web component, and showing in phantom the manner in which the frame assemblies may be collapsed.

The foot and ankle straps 12 and 14, respectively, may be made of any suitable flexible (non-stretchable) strip of fabric (such as canvas) or strip of plastic material. The foot strap 12 has a mid-portion **12*a* which extends between, and is fastened to (as by rivets 12*b*), side frame members 16 and 18 (as shown in FIG. 3). One end portion 12*c* of the foot strap 12 is looped through a buckle 12*d* and then fastened by a rivet 12*b* to its associated side frame member (member 16 as shown in FIGS. 2, 3 and 4). The other (extended length) end portion 12*e* of foot strap 12 is provided with VELCRO brand hook and eye fastener means 12*f* and 12*g* which when such portion is passed through buckle 12*d*, mate to maintain strap end portion 12*e* over the foot of a swimmer wearing the swimming propulsion aid 10 to assist in maintaining such aid to the swimmer's foot. The ankle strap 14 is provided at one of its ends 14*a* with a buckle 14*b*. The other (extended length) end portion 14*c* is provided with VELCRO fastener means 14*d* and 14*e* which, when such end portion is passed through buckle 14*b*, mate to maintain strap 14 in position about the ankle of a swimmer wearing the swimming propulsion aid 10. The ankle strap 14 is held in place under the heel plate 20** by extending such strap through strap slots 2O*c* and **20*d* in the heel plate as shown in FIGS. 2 and 4. The heel plate 20 also includes a strap slot 20*e* (see FIGS. 2 and 4) to which a heel strap 26 is affixed at one of its ends 26*a*. The free end 26*b* of the short heel strap 26 takes the form of a strap loop through which the ends of ankle strap 14** pass in their course about the swimmer's ankle as described hereinafter.

Figure 5:
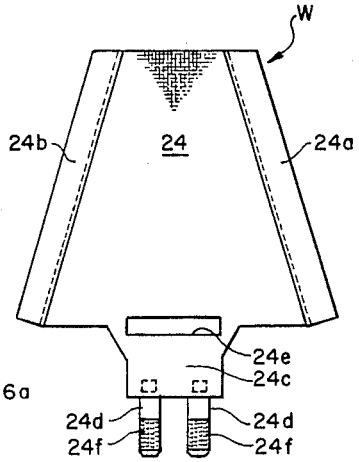
FIG. 5 is a top plan view of the fabric or plastic web component of the swimming propulsion aid of FIG. 2 prior to its assembly to the collapsible frame of the invention.

The web W of fabric (or flexible sheet plastic) material 24 forming the increased flipper area of the swimming propulsion aid 10 of the invention is maintained on the triangular frame F of the propulsion aid by side fabric loops **24*a* and 24*b* which encompass, respectively side frame members 16 and 18. The toe end of the web fabric material 24 extends across the frame proximate cross frame member 22 and includes (as particularly shown in FIG. 5) an end flap portion 24*c* which bears one or more relatively short flap straps 24*d*. The web fabric material 24, at the mid-section of the line of joinder of end flap portion 24*c*, presents an opening 24*e* through which the one or more flap straps 24*d* may be place to wrap the end flap portion 24*c* of the web about the cross frame member 22 to maintain such frame member in its fully extended form and thereby force the side frame members 16 and 18 outwardly from one-another as described hereinafter. The one or more flap straps 24*d* bear VELCRO fastener means 24*f* for maintaining flap portion 24*c* about cross frame member 22**.

Figure 6:
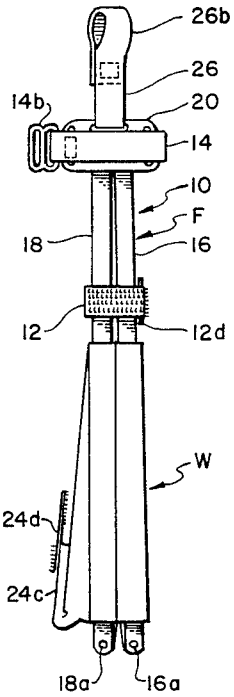
FIG. 6 is a top view of the swimming propulsion aid of FIG. 2 shown in collapsed form with the foot and ankle straps wound about the side frame members to maintain the swimming aid in its collapsed form.

In FIG. 4 a frame assembly of one of the swimming propulsion aids of the invention is shown without the web component W. In solid line presentation the side frame members 16 and 18 of the triangular frame F are spread to their position of wide angular orientation with the foldable cross frame member 22 extended to its full length. In the broken line presentation the side frame members 16' and 18' of frame F are partially collapsed with the components **22*a*' and 22*b*' of the cross frame member 22 partially folded about their connecting pivot point 22*c*'. With the web component W (of FIG. 5) in place on the triangular frame F of the swimming propulsion aid 10 and the web's end flap portion 24*c* free of its surrounding embracement of cross frame member 22 (see FIG. 2), the frame F and web W may be completely collapsed as shown in FIG. 6. In such collapsed form the foot strap 12 and ankle strap 14 may be wound about the side frame members 16 and 18** whereby the swimming propulsion aid takes its compact storage form.

Figure 7:
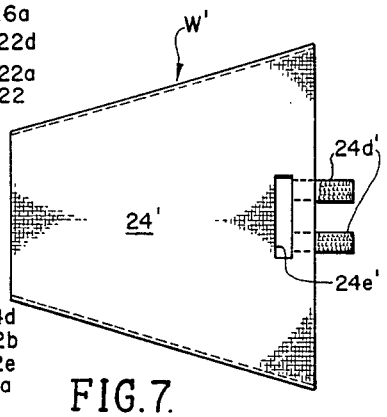
FIG. 7 is a top plan view of an alternative form of the web component of the swimming propulsion aids of the invention.

In FIG. 7 there is shown (in a top plan view) an alternative form of the web W' formed of a double layer of fabric 24' whereby the web can be readily slipped over the side frame members 16 and 18 when in their collapsed or partially collapsed position. The double layer of fabric 24, at the toe end of web W' covers the cross frame member of the triangular means) attached to one layer of the web fabric may be passed through opening **24*e***, in web to maintain the cross frame member in its fully extended form and thereby force the side frame members of the frame outwardly from one-another.

The above described embodiments of the swimming propulsion aid of the invention are easily assembled. The propulsion aid or swim flipper of FIGS. 2–6 has its web component W mounted to side frame members 16 and 18 via the web's side fabric loops **24*a* and 24*b* and thereafter the toe ends of such side frames are affixed to the foldable cross frame member 22 at pivot points 16*a* and 16*b*. The web flap portion 24*c* of web W is then wrapped about the foldable mid-portion of the cross frame member 22 with the flap straps 24*d* fastened thereabout to maintain the cross frame member 22 in its extended (non-folded) orientation to force the side frame members 16 and 18 outwardly from one-another. The mutually pivoting ends of components 22*a* and 22*b* of the cross frame member 22 may include snap means to assist in maintaining their extended orientation. With respect to the alternative form of flipper web component W' (shown in FIG. 7) the triangular frame is collapsed or partially collapsed, via the foldable cross frame member 22, and the web component W' is slipped over the frame. Thereafter, the cross frame member 22 is extended (unfolded) and the strip 24*d*' are passed through opening 24*e*'** in the web W' to maintain the cross frame member in its extended form.

To mount the swimming propulsion aid of the invention to a swimmer's foot, the swimmer's foot is positioned on one of the propulsion aids as shown in FIG. 2 with the swimmer's heel resting on the heal plate 22, the swimmer's arch spanning the mid-portion **12*a* of the foot strap 12, and the ball portion of the swimmer's foot resting on the heel end of the web W. The extended length end 12*e* of the foot strap 12 is thereafter affixed around and across the top of the foot with the end thereof looped through the buckle 12*d* with the VELCRO fastener means joined to maintain the foot strap in position to hold the swimming propulsion aid to the swimmer's foot. The ankle strap 14, which passes through slots 2Oc and 20*d* in the heel plate 20 as shown in FIGS. 2 and 4, has its ends 14*a* and 14*c* drawn forwardly across each other in front of the swimmer's ankle and thence around the leg, through the loop 26*b* of heel strap 26, and thence forwardly around the leg with the terminal end 14*c* (bearing VELCRO fastener means 14*d* and 14*e*) looped through buckle 14*b* with the fastener means 14*d* and 14*e*** mated to secure the rear portion of the swimming propulsion aid to the swimmer's foot.

The side frame members and the cross frame member of the swimming propulsion aid of the invention are preferably made of this metallic strips with the resulting structure (including the straps and web member) being of relatively light weight. With the swimming propulsion aids of the invention mounted to a swimmer's feet, the swimmer is assisted in propelling himself of herself through the water with a minimum of leg flutter kick action because of the substantial increase in effective foot area of the swimmer.

While the present invention has been described with reference to preferred embodiments thereof, it is obvious that modifications and alterations of such embodiments will occur to others skilled in the art upon their reading and understanding of this specification. It is therefore to be understood that the present invention includes all such modifications and alterations, and equivalents thereof, being limited only by the scope of the following claims.

What I claim is:

1. In a flipper type swimming propulsion aid assembly for attachment to each foot of a swimmer to increase the swimmer's effective foot area during flutter kick swimming procedures:

(a) a collapsible frame comprised of side frame members of substantially equal length adapted for pivotal joinder to a heel plate at the heel end of said frame and a foldable cross frame member pivotably joined at its ends to the toe ends of the side frame member with the result that in its operative form said frame is of generally isosceles triangular configuration;

(b) a web component for said frame and comprised of a flexible material selected from the group consisting of fabric and sheet plastic materials said web component being of a configuration matching the operative form and size of said frame from its toe end to at least the mid-point of the side frame members, said web component including side means for receiving and maintaining the side frame members and including means at its toe end for maintaining said web stretched over the toe ends of said frame members and for maintaining said foldable cross frame member in its fully extended orientation across the toe end of said frame;

(c) a foot strap affixed to the size frame members and extending therebetween proximate the heel end of said web component, said foot strap being of a length in its opposite end portions extending from said side frame members sufficient to surround the forward portion of the swimmer's foot and connectively mate to affix said swimming aid assembly to the forward portion of the swimmer's foot; and (d) ankle straps each affixed to the heel plate of said frame and of a length in their opposite end portions sufficient to cross over the swimmer's foot, surround the rearward portion of the swimmer's foot, cross back around the swimmer's ankle and connectively mate to affix said swimming aid assembly to the heel portion of the swimmer's foot.

2. In a flipper-type swimming propulsion aid assembly for attachment to each foot of a swimmer as claimed in claim 1 wherein the web component of said swimming aid assembly is comprised of a single layer of a flexible material and the side means thereof for receiving and maintaining the side frame members comprises side loops of said material which encompass the side frame members.

3. In a flipper-type swimming propulsion aid assembly for attachment to each foot of a swimmer as claimed in claim 1 wherein the web component of said swimming aid assembly is comprised of a double layer of a flexible material and the side means thereof for receiving and maintaining the side frame members comprises side seams of the double layer web component along the side frame members of said frame.

4. In a flipper-type swimming propulsion aid assembly for attachment to each foot of a swimmer as claimed in claim 1 wherein a heel strap is affixed to the heel plate, said heel strap in its free end taking the form of a strap loop through which said ankle straps may pass when utilized to affix said swimming aid assembly to the heel portion of the swimmer's foot.

5. In a flipper-type swimming propulsion aid assembly for attachment to each foot of a swimmer as claimed in claim 1 wherein the foot strap in one end portion includes a buckle and in the other end portion includes hook and eye fastener means which are positioned to connectively mate upon insertion of said other end portion through said buckle.

6. In a flipper-type swimming propulsion aid assembly for attachment to each foot of a swimmer as claimed in claim 1 wherein one ankle strap in its end portion includes a buckle and the other ankle strap in its end portion includes hook and eye fastener means which are positioned to connectively mate upon insertion of said other ankle strap through said buckle.

7. In a flipper-type swimming propulsion aid assembly for attachment to each foot of a swimmer as claimed in claim 1 wherein the means at the toe end of said web component for maintaining said foldable cross frame member in its fully extended orientation across the toe end of the collapsible frame of said swimming aid assembly comprises an end flap portion of said web for wrapping about the mid-portion of the foldable cross frame member to maintain said cross frame member in its extended orientation.

* * * * *